US007174607B1

(12) United States Patent
Buettell

(10) Patent No.: US 7,174,607 B1
(45) Date of Patent: Feb. 13, 2007

(54) CARD ATTACHMENT

(75) Inventor: Bruce J. Buettell, Fullerton, CA (US)

(73) Assignee: J.A.M. Plastics, Inc., Anaheim, CA (US)

( * ) Notice: Subject to any disclaimer, the term of this patent is extended or adjusted under 35 U.S.C. 154(b) by 336 days.

(21) Appl. No.: 10/261,732

(22) Filed: Sep. 30, 2002

(51) Int. Cl.
*A44B 21/00* (2006.01)
*A45F 5/02* (2006.01)

(52) U.S. Cl. ..... 24/504; 24/499; 24/505; 24/506; 24/507

(58) Field of Classification Search ..... 24/513, 24/463, 494–496, 523, 531, 536, 564, 3.12, 24/458, 505–507, 3.11, 503, 504, 511, 499; 361/814; 296/97.6, 97.9; 40/1.5, 790, 792, 40/793, 658, 647, 648, 659; 248/451–453; 69/19

See application file for complete search history.

(56) References Cited

U.S. PATENT DOCUMENTS

| | | | | | |
|---|---|---|---|---|---|
| 9,143 | A | * | 7/1852 | Wardwell | 122/6.6 |
| 152,200 | A | | 6/1874 | Wardwell | |
| 281,543 | A | | 7/1883 | Mayo | |
| 609,198 | A | | 8/1898 | Graves | |
| 610,967 | A | | 9/1898 | Hill | |
| 748,423 | A | * | 12/1903 | Schaffner | 24/564 |
| 792,717 | A | | 6/1905 | Mensor et al. | |
| 823,379 | A | * | 6/1906 | Walsh | 40/647 |
| 839,226 | A | * | 12/1906 | Silverstein | 24/499 |
| 1,336,129 | A | * | 4/1920 | Cass et al. | 24/458 |
| 1,373,619 | A | | 4/1921 | Kohn | |
| 1,962,186 | A | | 6/1934 | Finkbeiner | |
| 2,540,546 | A | * | 2/1951 | Putz | 24/564 |
| 3,145,442 | A | | 8/1964 | Brown | |
| 3,950,829 | A | * | 4/1976 | Cohen | 211/124 |
| 4,086,686 | A | | 5/1978 | Takabayashi | |

(Continued)

FOREIGN PATENT DOCUMENTS

| | | | |
|---|---|---|---|
| CH | 526284 | A | 8/1972 |

(Continued)

OTHER PUBLICATIONS

J.A.M. Plastics, Inc. Product Catalog "The Badge Holder Specialist", Oct. 1, 2000; two pages (14,5).

(Continued)

*Primary Examiner*—Jack W. Lavinder
(74) *Attorney, Agent, or Firm*—Knobbe, Martens, Olson & Bear, LLP

(57) ABSTRACT

The present invention relates to a card attachment for holding cards. The jaws of the card attachment can be locking in a closed position to ensure a secure grip on a card. Plastic gripping pads are included to increase the friction between the card and the jaws. Side walls are included to limit the distance a card may be inserted into the card attachment. Limiting the insertion of a card in this manner allows a card to be held without covering large amounts of the card. The ratio of an insertion length to the length of the side wall is selected to allow a card to be held securely without covering excessive amounts of the card. Thus a card can be held without covering pictures, words, or indicia on the card.

4 Claims, 3 Drawing Sheets

U.S. PATENT DOCUMENTS

| | | | | | |
|---|---|---|---|---|---|
| 4,141,119 | A | | 2/1979 | Nodo | |
| 4,277,864 | A | | 7/1981 | Orson, Sr. | |
| 4,463,482 | A | | 8/1984 | Hawie | |
| 4,493,495 | A | * | 1/1985 | Linn | 24/494 |
| 4,526,374 | A | * | 7/1985 | Ban | 473/231 |
| 4,722,120 | A | * | 2/1988 | Lu | 24/564 |
| 5,016,326 | A | | 5/1991 | Goldenberg | |
| 5,400,483 | A | | 3/1995 | Noda | |
| 5,410,783 | A | * | 5/1995 | Stoelinga | 24/511 |
| 5,564,166 | A | | 10/1996 | Roy | |
| 5,632,069 | A | | 5/1997 | Mievis | |
| 5,640,742 | A | | 6/1997 | White et al. | |
| 5,655,270 | A | | 8/1997 | Boisvert | |
| 5,842,256 | A | | 12/1998 | Anscher | |
| 5,863,021 | A | | 1/1999 | Nichols | |
| 5,890,638 | A | | 4/1999 | Woloshen | |
| 5,933,922 | A | | 8/1999 | Ochsman | |
| 6,085,393 | A | | 7/2000 | Tsui et al. | |
| 6,260,244 | B1 | | 7/2001 | Noda | |
| 6,301,751 | B1 | | 10/2001 | Ohlson | |
| 6,357,089 | B1 | * | 3/2002 | Koguchi et al. | 24/536 |
| 6,381,810 | B2 | | 5/2002 | Hsieh | |
| 6,612,000 | B2 | * | 9/2003 | Housley | 24/564 |

FOREIGN PATENT DOCUMENTS

| | | |
|---|---|---|
| DE | 88 11 220 U | 11/1988 |
| JP | 2003-103966 | 4/2003 |

OTHER PUBLICATIONS

International Search Report reflected on Copy of Form PCT/ISA/210(second sheet).

* cited by examiner

CARD ATTACHMENT

BACKGROUND OF THE INVENTION

1. Field of the Invention

The present invention relates to a card attachment that grasps a card or similar object to facilitate use and display of the card.

2. Description of the Related Art

Identification cards, credentials, badges, access cards and similar items are becoming common place in today's society. People are often required to display identification cards, badges, and/or access cards in certain places such as offices, conventions, special events and other secure areas. Typical methods of displaying such cards or badges include a first device such as a neck or wrist lanyard, a clip, or a pin that connect to a users clothing and a second device that retains the card to be displayed. Among the most common devices for retaining a card or badge are clips, key rings, strap clips, and swivel hooks.

Most frequently, clips, key rings, strap clips, and swivel hooks connect with a slot or hole that must be punched in the card. For many applications, however, a slot or hole is undesirable and impractical. Punching slots or holes in cards takes time, creates a weak spot in the card, compromises the protective overlay protecting the card's graphics and requires additional hole punching equipment. Slots punched in cards can interfere with the writing, pictures, or logos displayed on a card. Also, some cards include embedded electronics or magnetic stripes that prevent users from punching holes or slots. Thus, many applications require an alternative method of display.

Wallet or envelope-type card holders are the most common types of card display devices that do not require slots or holes. These devices are typically made of a vinyl type plastic and hold a card in a pocket. The plastic pocket typically encases a card with a clear portion allowing the card to be viewed while encased. Cards with magnetic stripes or electronic chips often cannot be used in their corresponding electronic reading devices while encased in such holders.

The only device on the market today that allows the display of a card without a slot, hole, or envelope encasement is a clothespin-like clip. The clothespin-like grasping mechanisms grip a card between two jaws and are available in a variety of styles and shapes. These card attachments, however, have proven ineffective and thus have experienced very little widespread adoption in the market.

The clothespin-type clip card attachments have two jaws that function with a pinching motion to open and close the jaws. An internal coil spring or leaf spring provides the force to close the jaws and grasp a card between the jaws. Part of the reason these card attachments have realized very little market penetration is that the clip card attachments on the market today simply do not hold well enough. Friction pads have been added to the clip card attachments in an effort to improve the grip of the clip card attachments, however these too have proven ineffective in practice.

Among other reasons why the clip card attachments on the market today fail is the fact that they can be inadvertently opened. Nothing in the clips prevents the jaws from being opened or locks them in place. Thus, cards can be accidentally dropped if any significant force is applied to the clip.

Another drawback of the clip card attachments on the market today is that they typically cover too much of the surface of a card. Generally, the clip card attachments employ large jaws to increase the area of contact between the card and clip card attachment. Large gripping surfaces are undesirable, however, as the jaws can extend so far onto a card's face that the visual appearance of the card is partially covered or distorted by the jaws. Today's clip card attachments do not provide a guide to assist proper insertion of a card. Often, the large jaws of the clip card attachments on the market today will cover up a portion of a logo, picture, or writing that appears on the card, disturbing the visual appearance of the card. Also, for some cards, such as those with embedded electronics or magnetic stripes, large jaws can interfere with their function.

Notwithstanding the different types of clip card attachments available, it is believed that there is a need for an improved card attachment that is easy to operate and provides a secure grip on a card without covering too much of the card.

SUMMARY OF THE INVENTION

The present invention relates to a card attachment and discloses several embodiments. One aspect of the disclosed invention is a lever and cam clip design in which the lever locks the clip's jaws and gripping friction pads into the closed position until opened by the user. Another aspect of the disclosed invention is a side wall that limits the distance a card can be inserted into a space between open jaws of the card attachment. Another feature of some embodiments is the decreased amount of a card that must be covered by the card attachment for the card attachment to securely grip the card. In another feature of the disclosed invention, the ratio of the gripping surface to the insertion distance is favorable. Yet another feature of several embodiments is a gripping surface with an increased coefficient of friction that securely grasps a card.

DETAILED DESCRIPTION

Figure 1:
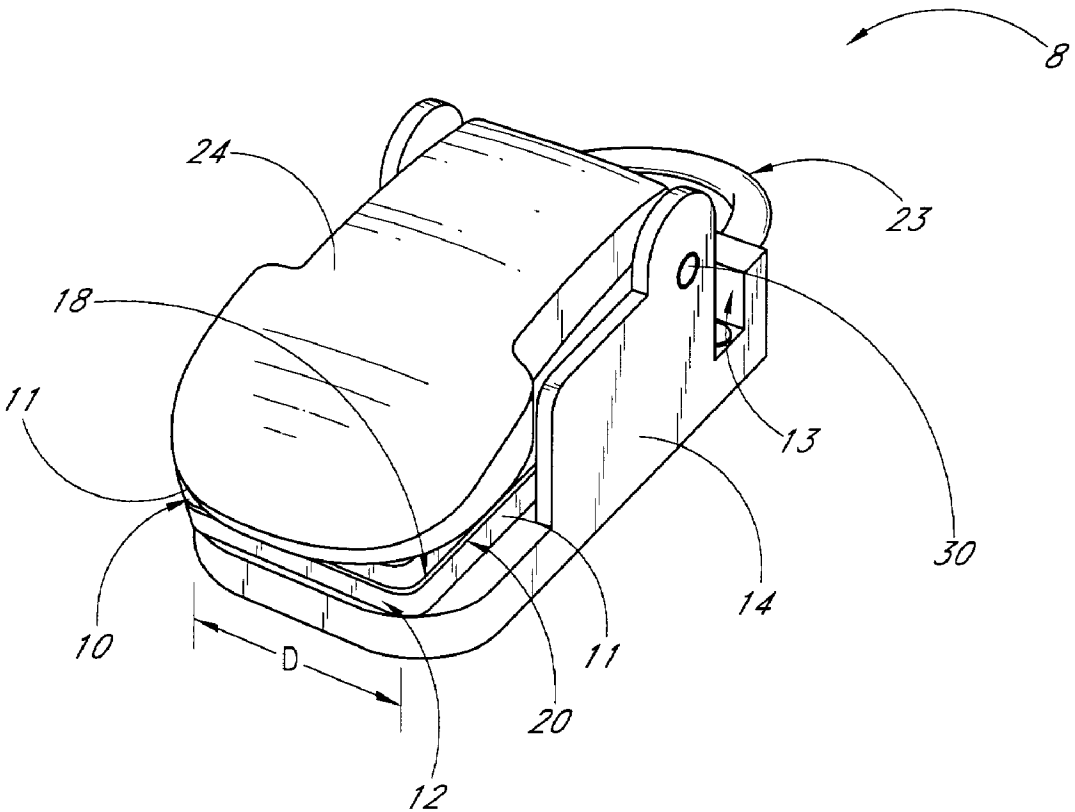
FIG. 1 is a perspective view of a card attachment incorporating the invention.
Figure 2:
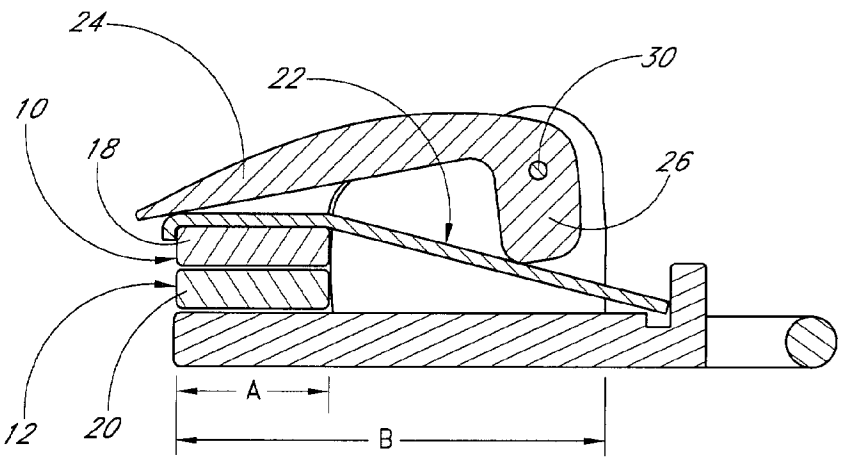
FIG. 2 is a cross-sectional side view of the card attachment of FIG. 1 in the closed position.
Figure 4:
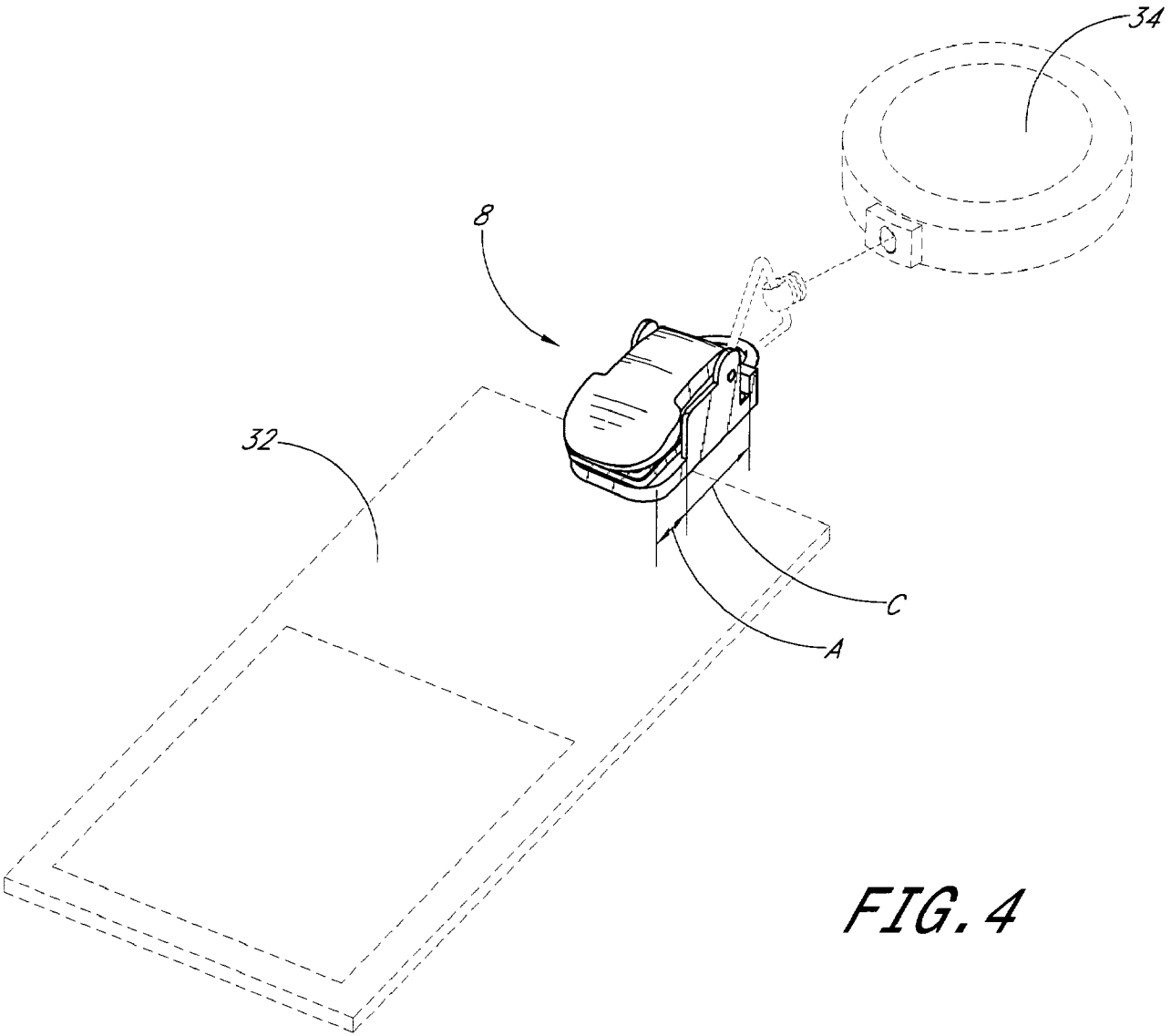
FIG. 4 is a plan view of the card attachment grasping a card and with a retractable reel attached.

FIG. 1 depicts one embodiment of the disclosed card attachment 8. The card attachment 8 includes a first jaw 10 and a second jaw 12. The second jaw 12 is substantially fixed while the first jaw 10 moves up and down. The first jaw 10 and the second jaw 12 preferably include gripping pads 11. The first jaw 10 includes a first gripping surface 18 and the second jaw 12 includes a second gripping surface 20. In many preferred embodiments, the gripping surfaces 18 and 20 are the portions of the gripping pads 11 that contact a card 32 as it is grasped by the card attachment 8. The card attachment 8 has a closed position, shown in FIG. 2, in which the jaws are pressed together and an open position, shown in FIG. 3, in which the jaws are spread apart.

The first jaw 10 and the second jaw 12 have a substantially parallel orientation when closed. In many embodiments, a spring 22 is connected to the first jaw 10 at one end and, at the other end, to the second jaw 12. The second jaw 12 engages one end of the spring 22 in such a way as to anchor that end of the spring 22. In many preferred embodiment, the spring 22 is a leaf spring. In many embodiments, one end of the spring 22 is anchored by a slot 23 in the second jaw 12 at the pivot point 13. In other embodiments, a lever may attach the first jaw 10 to the second jaw 12.

Figure 3:
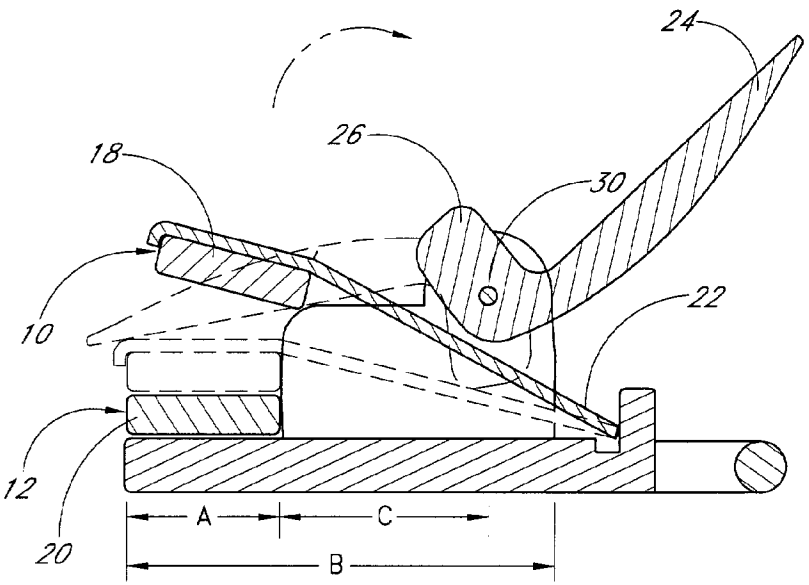
FIG. 3 is a cross-sectional side view of the card attachment of FIG. 1 in the open position.

In the closed position, force from the spring 22 presses the first jaw 10 and second jaw 12 together. In the embodiment shown in FIG. 2, a lever 24 with an attached cam 26 interacts with the spring 22. While it is not necessary, in many of the preferred embodiments, the cam 26 is part of the lever 24. The lever arm 24 and the cam 26 rotate about a pivot pin 30, as shown in FIG. 3, while the second jaw 12 remains relatively fixed.

The spring 22 also acts against the cam 26 in the closed position, preventing the cam 26 from moving, and thereby locking the first jaw 10, the cam 26, and the lever arm 24 in their closed positions. The card attachment 8 will remain in the closed position until a user opens the card attachment 8 by lifting the lever arm 24. Similarly, the spring 22 resists movement of the cam 26 from the open position to the closed position such that the card attachment 8 will remain in the open position unless a user closes the card attachment 8 by applying force to the lever arm 24.

In some preferred embodiments, the gripping pads 11 are made of a soft plastic or rubber. In some embodiments, the gripping pads 11 fit over the first and second jaws 10 and 12 in a sleeve-like manner. In some embodiments, the gripping pads 11 are glued, riveted, molded into/onto, or otherwise attached to the jaws. Other embodiments use only one gripping pad 11 or other plastics, metal, coatings, or other materials or combinations of materials to grip a card. In one preferred embodiment, the gripping pads 11 are molded to the jaws 10 and 12 by placing the ends of the jaws in the mold before introducing the plastic.

FIG. 1 shows one of a pair of side walls 14. In many embodiments, the side walls 14 limit an effective gripping length A of the first gripping surface 18 and the second gripping surface 20. In some embodiments, the effective gripping length A of the first gripping surface 18 and the second gripping surface 20 is approximately ¼ inch. In some other embodiments, the effective gripping length A and a side wall length C are approximately equal where the side wall length C is the lateral distance from the hinge pin 30 to the furthest edge of the side wall 14. In another embodiment, the ratio of the effective gripping length A to the side wall length C is approximately one to two, however, many ratios would be effective. In another embodiment, the effective gripping length A is approximately half of a first jaw length B.

A card 32 is inserted into the card attachment 8 a distance equal to the effective gripping length A. In one preferred embodiment, the amount of the card 32 covered by the card attachment 8 measures approximately ¼ inch in length by ⅜ inch in width. Other embodiments feature other dimensions and different ratios of the effective gripping surface A to the side wall length C. Also, a number of different gripping widths D are possible.

Typical cards 32 are made of a hard plastic material. The gripping pads 11 are perferably of a material that has a coefficient of friction that enhances the connection between the gripping surfaces and a card 32. A relatively high coefficient of friction provides a secure grip even with a small contact area. The soft plastic used for the gripping pads 11 can deform slightly under the force of a hard plastic card 32 pressed against it, further ensuring a secure grip of the card 32. Also, the gripping pads 11 in some embodiments have gripping surfaces that create a somewhat tacky adhesion to a plastic card 32. A preferred material for the gripping pads 11 is plasticized polyvinyl chloride having a Shore A hardness of 65. Another preferred material for the gripping pad is rubber. Some preferred embodiments achieve a pull strength of seven pounds with a gripping surface that is only approximately ¼ inch by ⅜ inch. To solve the difficult problem of affixing the gripping pad to a jaw, the end of the jaw may be positioned in a mold and the gripping pad is molded to the jaw in a manner to obtain a mechanical connection. Also, the gripping pad can be bonded to the jaw with a suitable adhesive.

While the invention has been described in terms of a preferred embodiment, it will be understood that other arrangements fall within the scope of the following claims.

What is claimed is:

1. A card attachment comprising:

a first jaw and a separately formed second jaw, the first jaw being pivotally connected to the second jaw such that the first and second jaws can be moved between an open position in which the first and second jaws are spaced apart and a locked closed position in which the first and second jaws are pressed into abutment without overlap;

the first jaw comprising a biasing member that extends along the second jaw, the biasing member comprising a first gripping surface, the second jaw comprising a second gripping surface that opposes the first gripping surface, the first and second gripping surfaces extending in generally parallel planes when the first and second jaws are in the closed position;

the second jaw comprising a base with a first side wall and a second side wall extending upward from the base, the first and second side walls being laterally spaced by a distance less than a width of a widest portion of the biasing member, the first and second side walls being positioned between a first end of the biasing member and an opposite second end of the biasing member, the first and second gripping surfaces terminating at a first distance from a distal end of the second jaw and a distal surface of each of the first and second side wall being positioned at the first distance from the distal end of the second jaw;

a lever having a generally L-shaped configuration that defines a cam portion and a lever arm portion, a pivot pin pivotally connecting the lever to the first and second side walls such that the lever is not capable of substantial translation relative to the first and second side walls, the pivot pin extending through the cam portion of the lever, and the cam portion being adapted to contact the first jaw when the lever is pivoted to a position such that the lever arm portion is substantially parallel to the first jaw.

2. The attachment of claim 1, wherein the first and second gripping surfaces each comprises a gripping pad.

3. The attachment of claim 1, wherein the gripping pads are formed of a soft plastic or rubber material.

4. The attachment of claim 1, wherein the gripping pads fit over the first and second jaws in a sleeve-like manner.

* * * * *